US007693591B2

(12) United States Patent
Hoglund et al.

(10) Patent No.: US 7,693,591 B2
(45) Date of Patent: Apr. 6, 2010

(54) HVAC ZONE CONTROL PANEL WITH CHECKOUT UTILITY

(75) Inventors: Steven R. Hoglund, Minneapolis, MN (US); Paul G. Schwendinger, St. Louis Park, MN (US)

(73) Assignee: Honeywell International Inc., Morristown, NJ (US)

( * ) Notice: Subject to any disclaimer, the term of this patent is extended or adjusted under 35 U.S.C. 154(b) by 249 days.

(21) Appl. No.: 11/564,879

(22) Filed: Nov. 30, 2006

(65) Prior Publication Data

US 2008/0133060 A1 Jun. 5, 2008

(51) Int. Cl.

| | |
|---|---|
| ***G05B 15/00*** | (2006.01) |
| ***G01M 1/38*** | (2006.01) |
| ***G05D 23/12*** | (2006.01) |
| ***F16T 1/02*** | (2006.01) |
| ***F28F 27/00*** | (2006.01) |
| ***F25B 29/00*** | (2006.01) |
| ***F24F 3/00*** | (2006.01) |
| ***G06F 3/048*** | (2006.01) |

(52) U.S. Cl. ..... 700/83; 700/276; 700/277; 700/17; 236/18; 236/57; 165/200; 165/201; 165/205; 165/208; 715/810; 715/817; 715/772; 715/841

(58) Field of Classification Search ..... 700/17, 700/83, 276, 277; 165/200–201, 205, 208; 236/18, 57; 715/742, 810, 817, 841
See application file for complete search history.

(56) References Cited

U.S. PATENT DOCUMENTS

| | | | | |
|---|---|---|---|---|
| 3,664,414 | A | 5/1972 | Raleigh | |
| 3,892,104 | A | 7/1975 | Klee et al. | |
| 4,071,745 | A | 1/1978 | Hall | |
| 4,205,381 | A | 5/1980 | Games et al. | |
| 4,335,320 | A | 6/1982 | Garver | |
| 4,338,791 | A | 7/1982 | Stamp, Jr. et al. | |
| 4,495,986 | A | 1/1985 | Clark et al. | |
| 4,501,125 | A | 2/1985 | Han | |
| 4,530,395 | A | 7/1985 | Parker et al. | |
| 4,795,088 | A | 1/1989 | Kobayashi et al. | |
| 4,830,095 | A | 5/1989 | Friend | |
| 4,843,084 | A | 6/1989 | Parker et al. | |
| 4,932,466 | A | 6/1990 | Foster | |
| 5,024,265 | A | 6/1991 | Buchholz et al. | |
| D319,429 | S | 8/1991 | D'Aleo et al. | |
| 5,042,265 | A * | 8/1991 | Baldwin et al. | 62/127 |

(Continued)

FOREIGN PATENT DOCUMENTS

| | | |
|---|---|---|
| SI | 20556 | 10/2001 |

OTHER PUBLICATIONS

Aprilaire, "Intelligent Zoned Comfort Control System," Owners Manual Model 6504, pp. 1-12, prior to Nov. 30, 2006.

(Continued)

*Primary Examiner*—Ronald D Hartman, Jr.

(57) ABSTRACT

A zone control panel may be adapted to accommodate a method of verifying communication and/or connections between the zone control panel and one or more thermostats that are electrically connected to the zone control panel. In some cases, the one or more thermostats may be set to a particular state or condition, and the zone control panel may be adapted to sequentially or simultaneously display the particular state or condition of each of the one or more thermostats.

18 Claims, 13 Drawing Sheets

U.S. PATENT DOCUMENTS

| | | | | |
|---|---|---|---|---|
| 5,092,394 | A | 3/1992 | Foster | |
| 5,129,234 | A | 7/1992 | Alford | |
| D329,226 | S | 9/1992 | Holbrook | |
| 5,161,608 | A | 11/1992 | Osheroff | |
| 5,245,835 | A | 9/1993 | Cohen et al. | |
| 5,303,767 | A | 4/1994 | Riley | |
| 5,318,104 | A | 6/1994 | Shah et al. | |
| 5,344,069 | A | 9/1994 | Narikiyo | |
| 5,348,078 | A * | 9/1994 | Dushane et al. | 165/209 |
| 5,449,319 | A | 9/1995 | Dushane et al. | |
| 5,495,887 | A | 3/1996 | Kathnelson et al. | |
| 5,751,572 | A | 5/1998 | Maciulewicz | |
| 5,818,194 | A | 10/1998 | Nordby | |
| 5,829,674 | A | 11/1998 | Vanostrand et al. | |
| 5,860,473 | A | 1/1999 | Seiden | |
| 5,944,098 | A | 8/1999 | Jackson | |
| 5,983,890 | A | 11/1999 | Thomas et al. | |
| 6,196,467 | B1 | 3/2001 | Dushane et al. | |
| D449,279 | S | 10/2001 | Takach, Jr. et al. | |
| D454,544 | S | 3/2002 | Takach, Jr. et al. | |
| 6,402,043 | B1 | 6/2002 | Cockerill | |
| 6,540,148 | B1 | 4/2003 | Salsbury et al. | |
| 6,574,581 | B1 * | 6/2003 | Bohrer et al. | 702/130 |
| 6,705,533 | B2 | 3/2004 | Casey et al. | |
| 6,711,471 | B2 | 3/2004 | Kidder | |
| 6,725,914 | B2 | 4/2004 | Petterson | |
| 6,851,621 | B1 | 2/2005 | Wacker et al. | |
| 6,856,841 | B2 | 2/2005 | Peterson | |
| 6,874,693 | B2 | 4/2005 | Readio et al. | |
| 6,879,881 | B1 | 4/2005 | Attridge, Jr. | |
| 6,964,174 | B2 * | 11/2005 | Shah | 62/129 |
| 6,967,565 | B2 | 11/2005 | Lingemann | |
| 6,986,708 | B2 | 1/2006 | Demster | |
| 6,997,390 | B2 | 2/2006 | Alles | |
| 7,000,849 | B2 | 2/2006 | Ashworth et al. | |
| 7,017,827 | B2 | 3/2006 | Shah et al. | |
| 7,047,092 | B2 | 5/2006 | Wimsatt | |
| 7,055,759 | B2 | 6/2006 | Wacker et al. | |
| 7,106,019 | B2 | 9/2006 | Becerra et al. | |
| 7,114,554 | B2 | 10/2006 | Bergman et al. | |
| 7,130,719 | B2 | 10/2006 | Ehlers et al. | |
| 7,130,720 | B2 | 10/2006 | Fisher | |
| 7,150,408 | B2 | 12/2006 | DeLuca | |
| 7,156,316 | B2 * | 1/2007 | Kates | 236/1 B |
| 7,188,002 | B2 | 3/2007 | Chapman, Jr. et al. | |
| 7,228,693 | B2 | 6/2007 | Helt | |
| 7,320,362 | B2 | 1/2008 | Nichols | |
| 7,360,370 | B2 | 4/2008 | Shah et al. | |
| D590,352 | S | 4/2009 | Jacoby et al. | |
| 2003/0103075 | A1 | 6/2003 | Rosselot | |
| 2004/0194484 | A1 | 10/2004 | Zou et al. | |
| 2004/0262410 | A1 * | 12/2004 | Hull | 236/91 R |
| 2005/0040248 | A1 | 2/2005 | Wacker et al. | |
| 2005/0040249 | A1 * | 2/2005 | Wacker et al. | 236/51 |
| 2005/0049307 | A1 | 3/2005 | Starnes, Jr. et al. | |
| 2005/0103875 | A1 * | 5/2005 | Ashworth et al. | 236/94 |
| 2005/0156049 | A1 | 7/2005 | Van Ostrand et al. | |
| 2005/0159847 | A1 * | 7/2005 | Shah et al. | 700/276 |
| 2005/0159924 | A1 | 7/2005 | Shah et al. | |
| 2005/0228607 | A1 * | 10/2005 | Simons | 702/122 |
| 2006/0004492 | A1 | 1/2006 | Terlson et al. | |
| 2007/0045429 | A1 * | 3/2007 | Chapman et al. | 236/46 C |
| 2007/0050732 | A1 | 3/2007 | Chapman, Jr. et al. | |
| 2007/0057075 | A1 * | 3/2007 | Votaw et al. | 236/1 B |
| 2007/0225868 | A1 | 9/2007 | Terlson et al. | |

OTHER PUBLICATIONS

Robertshaw, "SlimZone Premier Zone Control System," Installation and Operation Manual, pp. 1-32, prior to Nov. 30, 2006.

http://www.appliancemagazine.com/printphp?article=1463 &zone=211&first=1, Appliance Magazine.com, "High-Efficiency HVAC Motor," 1 page, Jul. 2006.

http://www.ewccontrols.com/ultrazone/new_stuff.htm, "Newest Product, UZC4," 3 pages, Oct. 20, 2005.

http://www.geindustrial.com/cwc/products?pnlid=4&id=ecmph, GE Consumer and Industrial Electrical Distribution, ECM Product Information, 1 page, printed Feb. 28, 2007.

http://www.geindustrial.com/cwc/products?id=ecm&famid=23, GE Consumer and Industrial Electrical Distribution, GE ECM 2.3 Series Product Information, 2 pages, printed Feb. 28, 2007.

http://www.hvac-talk.com/vbb/printthread.php?t=99837&pp=40, "HVAC-Talk: Heating, Air & Refrigeration Disscussion," 5 pages, on or before Nov. 30, 2006.

http://www.hvac-talk.com/vbb/showthread.php?t=121627 &hightlight=zone+timer, "Multi Stage Control—Zone Board or Tstat," 2 pages, Nov. 17, 2006.

http://www.hvac-talk.com/vbb/showthread.php?t=75867 &highlight=DEHUM+zone+control, "Update on 4-Zone Arzel + Tappan Installation," 5 pages, May 2005.

http://www.jacksonsystems.com/index.php?module=z600, Jackson Systems, LLC, "Coming in March, Residential and Light Commercial Zone Control (Z-600) Two Position," 2 pages, at least as early as Feb. 8, 2007.

http://www.lennoxcommercial.com/support/faq.asp?a=a&category2&question=76, Lennox, "What is a Variable Speed Furnace?" 2 pages, 2007.

http://www.weinstall.ca/two_stage_heating.htm, "Clarkson Comfort Zone Two Stage Heating Variable Speed Furnace Systems," 2 pages, printed Jan. 26, 2007.

http://www.westinghousehvac.com/wh92_2stgvarspd.asp, Westinghouse Cooling and Heating, "92.1%* AFUE Two-Stage Variable Speed Gas Furnace," 2 pages, printed Jan. 26, 2007.

Abb, "To Measure is to Know, DIN Rail Mounted Electricity Meters," 12 pages, Jan. 2006.

Abb "Enclosures and Cable Systems Overview," 10 pages, Nov. 2002.

Abb Installation Material, 2 pages, prior to Nov. 30, 2006.

Arzel Zoning Technology Inc., Product Catalog, 8 pages, 2006.

Bryant Heating & Cooling Systems, Model 340MAV, 350MAV, 355MAV, Condensing Gas Furnace, User's Information Manual, 2 pages, prior to Nov. 30, 2006.

Bryant, Thermidistat Control,TSTAT Installation and Start-Up Instructions, pp. 1-12, Aug. 1999.

Carrier, 3V Control System, VVT Zone Controller, Pressure Dependent Controller, Installation, Start-Up and Configuration Instructions, pp. 1-60, Oct. 2004.

Carrier, 58MVB 4-Way Multipoise Variable-Capacity Condensing Gas Furnace, Installation, Start-Up and Operating Instructions, 2 pages, Aug. 2005.

Drew, "Proper Staging Techniques for Multi-Stage Thermostats," XCI Corporation, 4 pages, Dec. 2002.

Durozone ED3 Zoning Panel, 2 pages, 2004.

EWC Control Inc., Model NCM 300 Zone Control System Technical Bulletin, pp. 1-12, 2000.

EWC Control Inc., Model UZC4 Zone Control Technical Bulletin, pp. 1-24, Dec. 12, 2005.

GE Industrial Systems, "Troubleshooting GE ECM Driven Systems," 2 pages, prior to Nov. 30, 2006.

GE ECM, "The X13 Blower Demo," pp. 1-13, 2006.

Honeywell, EMM-3 Electronic MiniZone Panel Product Data, pp. 1-12, Oct. 2002.

Honeywell, EMM-3U Universal Electronic Minizone Panel, Product Data, pp. 1-16, Nov. 2002.

Honeywell, TZ-4 TotalZone Zone Control Panel, Product Data, pp. 1-20, Dec. 2002.

Jackson Systems, "Z-600 Zone Control Comfort System," 4 pages, at least as early as Dec. 29, 2006.

Lennox Industries Inc., G61 MPV Series Unit, Installation Instructions, 2 pages, Sep. 2006.

Lennox Industries Inc., Harmony III Zone Control System, Homeowner's Manual, 6 pages, Jan. 2005.

Lennox Industries Inc., Harmony III Zone Control System, Installation Instructions, 30 pages, Jan. 2006.
Lennox, "Harmony III Zoning System, Dave Lennox Signature Collection," 4 pages, May 2005.
RobertShaw, "Slimzone Premier Zone Control Panel," 2 pages, 2004.
Siemens, "3144 Building Technologies, HVAC Products, Universal Controllers RMU710, RMU720, and RMU730," pp. 1-15, Feb. 13, 2006.
Schneider Electric, "Square DQO Load Centers and Circuit Breakers, Unsurpassed Circuit Protection and Application Flexibility," 8 pages, 2004.
Taco Hydronic Components and Systems, Electronic Controls Catalog #100-5.0, 4 pages, Sep. 1, 2003.
Trane, "Tracker Version 12 Building Automation System," pp. 1-32, May 2003.
Variable Speed Motor Control Installation Instructions, pp. 1-29, Jul. 2006.
White Rodgers, "CZ-4 Master Control Panel," 6 pages, at least as early as Dec. 29, 2006.
XCI Controls, SmartZone System Manual, 20 pages, Oct. 3, 2005.
Zonefirst, "Masterzone Heat Pump Zoning System, Model MMH3," 2 pages, prior to Nov. 30, 2006.
Zonefirst, Mini-Masterzone Zoning System—3 Zones, Installation and Operating Instructions, 4 pages, 2003.
Zonex, "DIGI3U 3-Zone Universal Controller for G/E or Heat Pump Applications," 2 pages, at least as early as Dec. 2, 2006.
Square D, "QO Load Centers and Circuit Breakers, Unsurpassed Circuit Protection and Application Flexibility," 8 pages, 2004.

* cited by examiner

HVAC ZONE CONTROL PANEL WITH CHECKOUT UTILITY

TECHNICAL FIELD

The present invention relates generally to HVAC equipment and more particularly to zone control panels for controlling HVAC equipment.

BACKGROUND

A variety of residential and commercial buildings have HVAC equipment that may, for example, provide conditioning such as heating, cooling, ventilation, filtration, humidification, and/or dehumidification to improve the environment within the residential and/or commercial building.

In some instances, a building may be divided into two or more zones that may be independently conditioned in order to provide more precise control of the environment within the building. A thermostat may be located within each zone, and each thermostat may be electrically connected to a zone control panel that is configured to receive signals (e.g. requests) from the thermostats and provide appropriate commands to HVAC equipment in response to the requests.

Each thermostat may have a number of electrical connections that need to be made with the zone control panel for proper operating of the system. During or after an installation process, it may be desirable to confirm that each electrical wire or lead from each thermostat is connected to the appropriate pin or connection of the zone control panel. A current method of testing these connections requires that an installer set each thermostat to a particular condition such as heat on, air conditioning on, or the like, and then move to the zone control panel and manually check the state of the appropriate pins on the zone control panel with a voltmeter. This method of testing has proven to be fairly labor intensive and error-prone, particularly when dealing with HVAC systems that have a relatively large number of zones and/or include a relatively large number of control signals between the thermostats and the zone control panel. In order to save time, it has been found that many installers often only check the voltage state of some of the pins. For example, if the installer has set a particular thermostat to call for heat, the installer may only check the voltage on the heat call pin (e.g. W pin), but not the other pins. This may increase the likelihood that an erroneous wire connection goes undetected.

A need remains, therefore, for improved testing methods for verifying connections between a zone control panel and the thermostats connected to the zone control panel. A need also remains for an improved zone control panel that may facilitate such methods.

SUMMARY

The present invention relates generally to a method for verifying connections between a zone control panel and thermostats connected to the zone control panel, as well as a zone control panel that facilitates such a method. In one illustrative embodiment, a zone control panel may be configured to receive electrical signals from one or more thermostats that may be remotely located. In some instances, the zone control panel may include a mode button that permits a user to place the zone control panel into a checkout mode, but this is not required. The zone control panel may also include a mode indicator light that can show when the zone control panel is in the checkout mode, but again, this is not required.

In some cases, the zone control panel may include a user interface. The user interface may, in some cases, include a control pad that permits a user to select a particular thermostat and/or a display to provide the installer with information pertaining to the selected thermostat. In some instances, information may be displayed on an alphanumeric display or the like, but this is not required. The information pertaining to a particular thermostat may include, for example, the state of an input signal received from the thermostat, such as a heat call input signal (e.g. W pin), a cool call input signal (e.g. Y pin), a fan call signal (e.g. G pin), or any other suitable input signal, as desired. In some embodiments, there may be a plurality of remotely operated thermostats, and the zone control panel may be configured to display information pertaining to each of the plurality of remotely operated thermostats. The information may be displayed simultaneously for more than one thermostat, sequentially, or a combination thereof, as desired.

In some cases, in operating the zone control panel, it may be desired to connect the one or more thermostats to the zone control panel, set at least selected thermostats to an operating condition and then display the operating condition of each of the selected thermostats. In some illustrative embodiments, the zone control panel may be placed into a checkout mode, but this is not required. The operating condition of one or more of the thermostats may be changed, in some cases while the zone control panel is displaying the operating condition of the one or more thermostats.

The above summary of the present invention is not intended to describe each disclosed embodiment or every implementation of the present invention. The Figures, Detailed Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
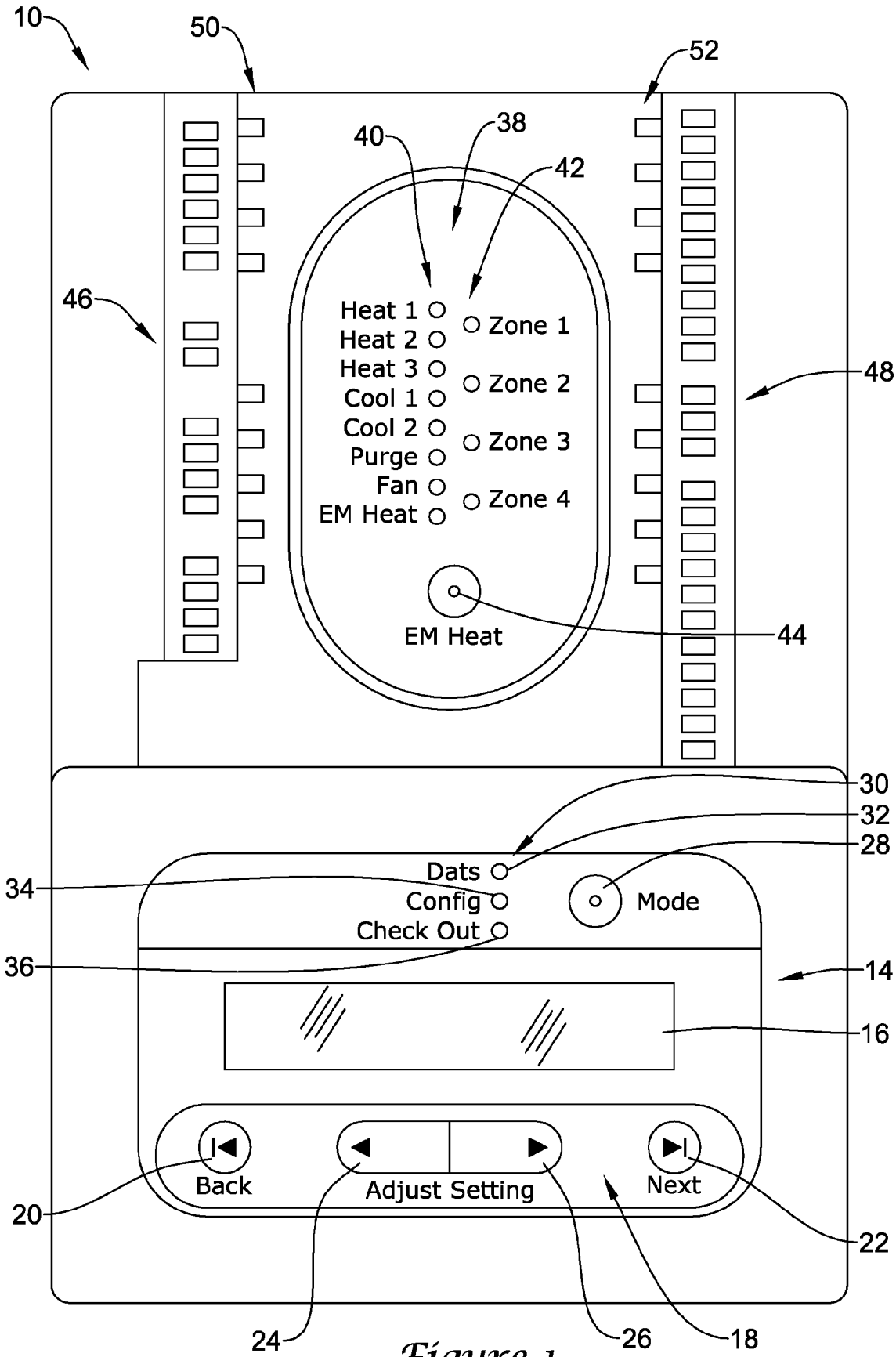
FIG. 1 is a front view of an illustrative but non-limiting zone control panel in accordance with the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The present invention pertains generally to multi-zone HVAC systems, in which two or more thermostats are electrically connected to a zone control panel. The two or more thermostats, which may each be located within a distinct zone of a conditioned space, may provide the zone control panel with calls for heat, cooling, filtration, ventilation, fan, and/or the like. The zone control panel may, in turn, provide appropriate instructions or signals to the appropriate HVAC equipment such as heating equipment, air conditioning equipment, ventilation equipment, humidification and/or dehumidification equipment, and/or the like. If the thermostats placed within different zones make different calls for heating, cooling and the like, the zone control panel may provide appropriate instructions or signals to open or close particular zone dampers.

FIG. 1 shows an illustrative but non-limiting zone control panel 10. The illustrative zone control panel 10 may include a user interface 14 that may be used to program and/or operate zone control panel 10. In the illustrative embodiment shown in FIG. 1, user interface 14 includes a display 16.

As will be discussed in greater detail with respect to subsequent Figures, display 16 may be used to display information that is pertinent to one or more of the thermostats that may be electrically connected to zone control panel 10. Display 16 may be any suitable display including, for example, a liquid crystal display, an alphanumeric display, a fixed segment display, a dot matrix display, a touch screen display, or any other suitable display, as desired. More generally, display 16 may be any type of display that conveys appropriate information to a user.

Alternatively, or in addition, it is contemplated that the display 16 may include a number of spaced light sources such as Light Emitting Diodes (LEDs). In one illustrative embodiment, each LED may correspond to a particular pin of the zone control panel. For example, one LED may correspond to the heat call pin (e.g. W pin), another LED may correspond to a cool call pin (e.g. Y pin), yet another LED may correspond to a fan call pin (e.g. G pin), etc. Other LEDs may correspond to other pins of the zone control panel, as desired. When a particular pin of the zone control panel 10 is asserted by a thermostat, the corresponding LED may illuminate. In some cases, the spaced LED light sources may be shared by two or more zones. For example, the user interface 14 may include a zone selector to select a particular zone. Then, when a particular pin of the selected zone of the zone control panel 10 is asserted by the corresponding thermostat, the zone control panel 10 may cause the corresponding LED to illuminate to help verify proper connectivity. When a different zone is selected by the zone selector, the zone control panel 10 may use the same set of LEDs to display the state of the pins of the newly selected zone. In some instances, it is contemplated that display 16 may include or be formed from a multi-line array of LEDs that together may form an alphanumeric display.

In some illustrative embodiments, user interface 14 may also include a control pad 18. Control pad 18 may be used to help negotiate menus, to enter parameters or parameter values and the like. In the illustrative embodiment, control pad 18 may include a back button 20 and a next button 22 that may be used to, for example, select among menu items or perhaps to select between sub-menus within a larger menu. The illustrative control pad 18 may also include a first arrow button 24 and a second arrow button 26. In some cases, first arrow button 24 and/or second arrow button 26 may be used to, for example, change a parameter or a parameter value.

As illustrated, control pad 18 may include distinct mechanical buttons as back button 20, next button 22, first arrow button 24 and second arrow button 26, but it is contemplated that at least part of control pad 18 could instead be implemented using a touch screen or may be implemented as soft keys, if desired. If control pad 18 is implemented as part of a touch screen, display 16 may also be formed as part of the same touch screen.

In some illustrative embodiments, user interface 14 may include a mode button 28. It will be appreciated that in some cases, zone control panel 10 may be switched between two or more different modes such as a setup or configuration mode, an operational mode and a checkout mode, for example. Mode button 28 may be configured to permit a user to toggle between these and potentially other operational modes, if desired.

In some cases, user interface 14 may also include a mode light set 30 that may provide visual confirmation of the particular mode selected. As illustrated, mode light set 30 includes an operational mode light 32, a configuration mode light 34 and a checkout mode light 36. As mode button 28 is toggled to move between these modes, the appropriate mode light may be illuminate. Any suitable light source may be used, although in some cases, operational mode light 32, configuration mode light 34 and checkout mode light 36 may each be LEDs.

Zone control panel 10 may include a secondary control panel 38. Secondary control panel 38 may, as illustrated, include a bank of HVAC status lights 40. The HVAC status lights 40 may be used to, for example, indicate whether the heating equipment is running, and if so, if the first stage, second stage or third stage heating equipment is running. Similarly, HVAC status lights 40 may be used to indicate the operational status of the cooling equipment, fan, ventilation equipment, and/or the like. In some cases, HVAC status lights 40 may also be used to verify that zone control panel 10 is able to communicate with and/or is properly connected to the appropriate HVAC equipment.

In some illustrative embodiments, secondary control panel 38 may also, if desired, include a bank of zone lights 42. In some cases, zone lights 42 may be used to indicate which zone dampers are open or closed, whether or not zone control panel 10 is able to communicate with each of the zone dampers within each zone, and/or which zones are currently making heating, cooling or ventilation demands, for example. In some cases, both HVAC status lights 40 and zone lights 42 may be LEDs, although this is not required. Secondary control panel 38 may also include an emergency heat button 44 that can be used to, for example, put the HVAC equipment into an emergency heating mode.

The illustrative zone control panel 10 may also include a first bank 46 of connection points and a second bank 48 of connection points. In some cases, one or both of first bank 46 and/or second bank 48, or portions thereof, may be used for electrically connecting each of the remotely located thermostats to zone control panel 10. In some cases, one or both of first bank 46 and/or second bank 48, or portions thereof, may be used for electrically connecting zone HVAC equipment and zone dampers to zone control panel 10.

In some instances, zone control panel 10 may include a first bank 50 of apertures disposed along first bank 46 of connection points and a second bank 52 of apertures disposed along second bank 48 of connection points. In some instances, first bank 50 of apertures and/or second bank 52 of apertures may be adapted to provide ventilation. In some cases, first bank 50 of apertures and/or second bank 52 of apertures may be absent.

In some instances, it is contemplated that first bank 50 of apertures and/or second bank 52 of apertures may be adapted to accommodate one or more indicator lights. Such indicator lights, if present, may be used to help confirm electrical connections between zone control panel 10 and one or more pieces of HVAC equipment, one or more zone dampers, and/or the like.

In FIG. 1, zone control panel 10 is shown without any covers, in order to illustrate particular features of zone control panel 10. It will be recognized that zone control panel 10 may include one or more covers that may fit over part or all of zone control panel 10 in order to protect zone control panel 10 from dust, to prevent inadvertent access to controls underneath the cover(s), or even to provide a more aesthetically pleasing appearance. If included, one or more covers may snap fit onto zone control panel 10. In some cases, for example, a cover may be configured to hide essentially all of zone control panel 10, except for secondary control panel 38.

Figure 2:
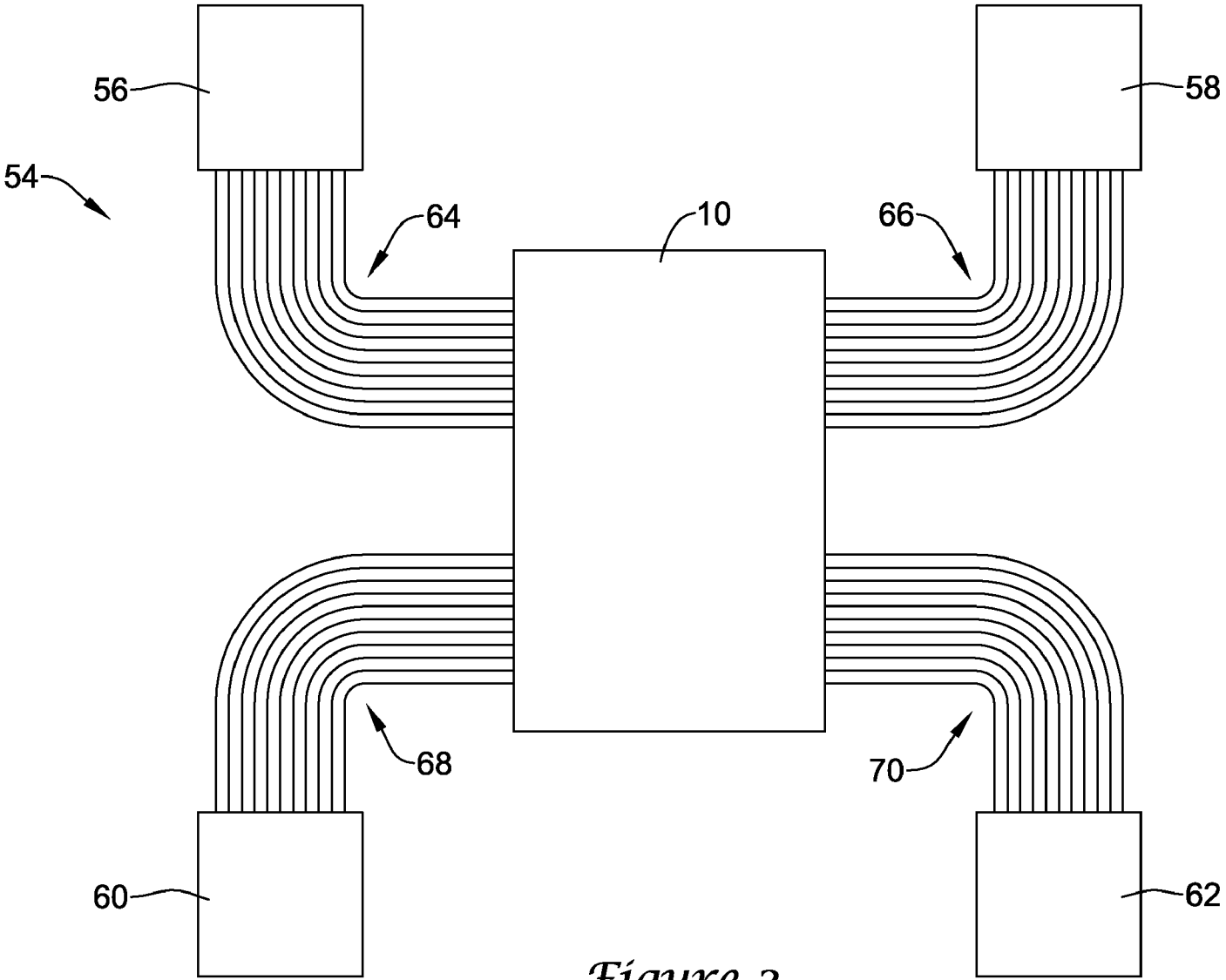
FIG. 2 is a diagrammatic schematic view of an illustrative but non-limiting HVAC control system in accordance with the present invention.

FIG. 2 shows an illustrative but non-limiting system 54 that includes a first thermostat 56, a second thermostat 58, a third thermostat 60 and a fourth thermostat 62 connected to zone control panel 10. As illustrated, first thermostat 56 is connected through a total of eleven wires 64, second thermostat 58 is connected through a total of eleven wires 66, third thermostat 60 is connected through a total of eleven wires 68 and fourth thermostat 62 is connected through a total of eleven wires 70. In other instances, each thermostat may instead be connected through two, three, four, five, six, seven, eight, nine, ten, or even more than eleven wires, depending on the type of HVAC equipment being controlled and the exact functionality of the thermostats.

As will be appreciated, wiring zone control panel 10 may involve a relatively large number of electrical connections. It can be important to ensure that all of these connections are correctly made, i.e., that each wire, lead or connector is secured to the appropriate connection point on the zone control panel 10, and that each wire, lead or connector is electrically intact. In some instances, zone control panel 10 may include a checkout mode that may include programming that permits an installer or other individual to help ensure that all of the connections are correctly made.

Figure 3A:
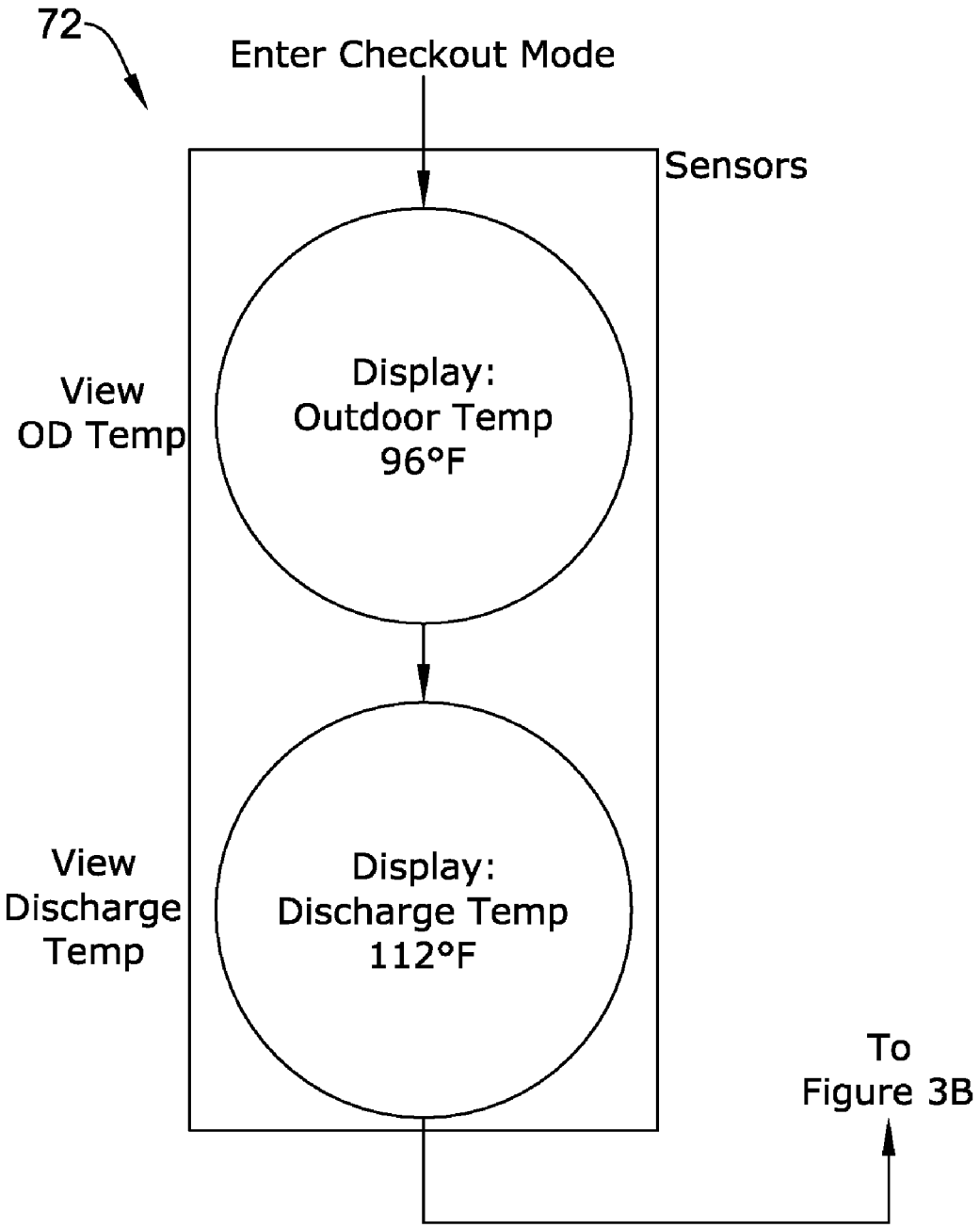
FIGS. 3A-3D show aspects of a checkout utility of the illustrative zone control panel of FIG. 1 in accordance the present invention.

FIGS. 3A-3D are, in combination, a flow diagram illustrating different features of an illustrative checkout mode that the zone control panel 10 may be programmed to provide. In FIG. 3A, zone control panel 10 has entered the checkout mode. In some cases, zone control panel 10 may be connected to one or more temperature sensors. In section 72 of the checkout mode, zone control panel 10 may sequentially display in display 16 of FIG. 1, an outdoor temperature and then a discharge temperature that may, for example, represent the temperature of air or another fluid exiting a heat source.

Figure 3B:
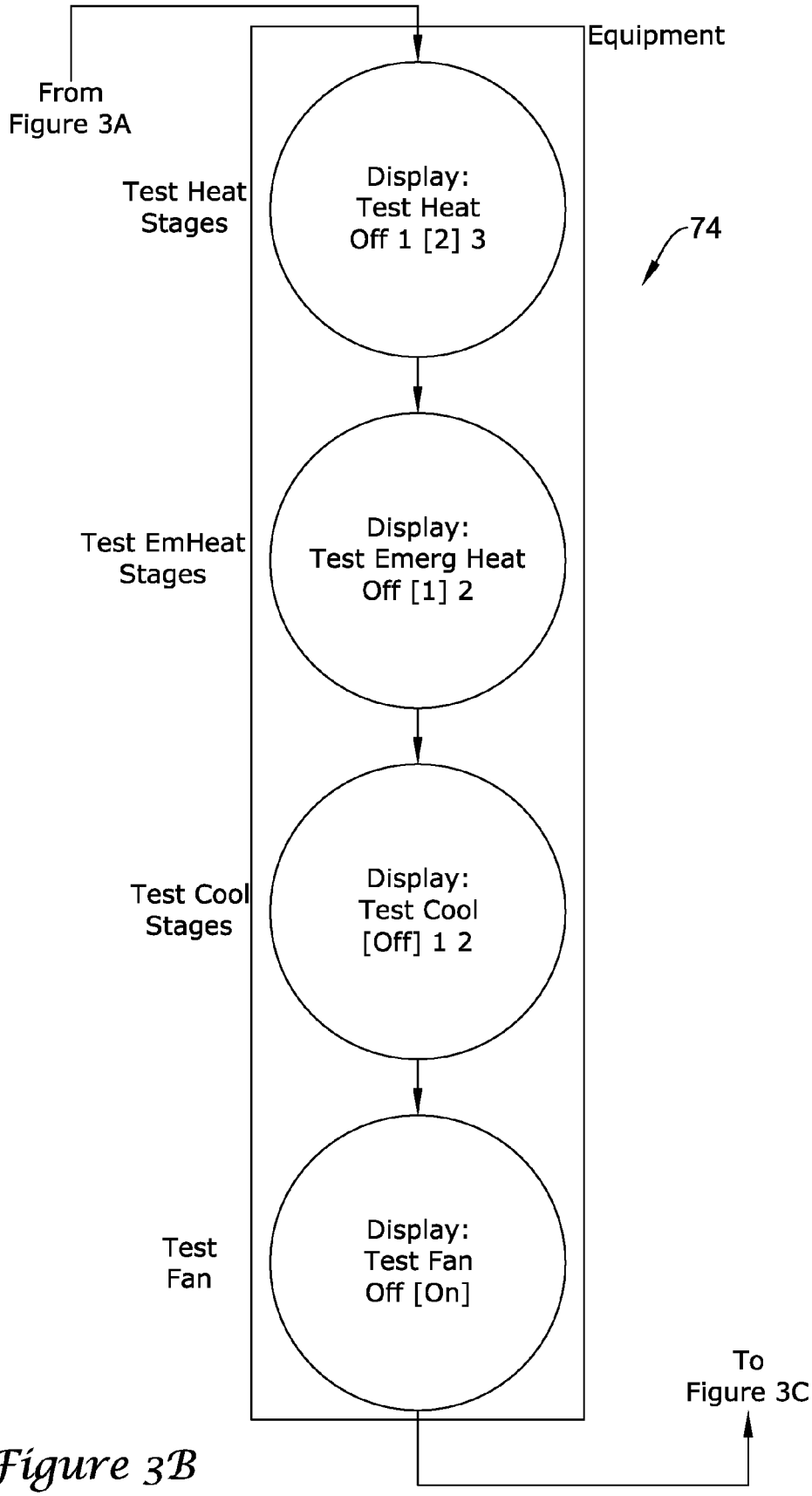

In FIG. 3B, the illustrative checkout mode proceeds to a section 74 in which the HVAC equipment is tested. This may test both the HVAC equipment itself as well as the electrical connections between the HVAC equipment and zone control panel 10. While section 74 illustrates testing three heat stages, it will be recognized that some HVAC equipment may only have a single heat stage, two heat stages, or even more heat stages, depending on the circumstances. Similarly, while some HVAC equipment may have two emergency heat stages, other equipment may have only a single emergency heat stage or may not include an emergency heat stage at all. Some HVAC equipment may even have three or more emergency heat stages. Some HVAC equipment may include two cooling stages, as shown, or may include only a single or no cooling stage. Some HVAC equipment may have three or more cooling stages. The fan is also tested in section 74, as shown.

Figure 3C:
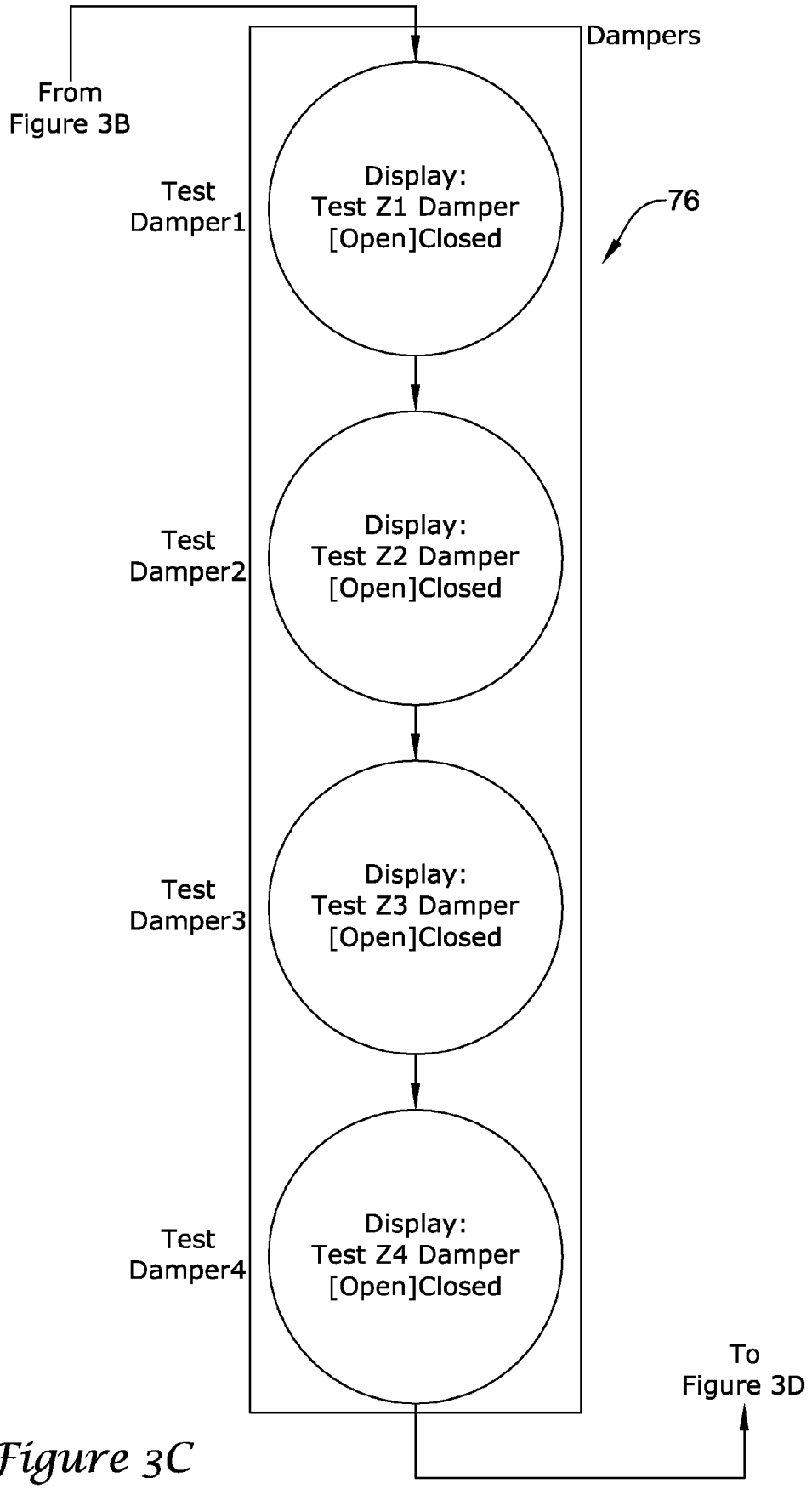

In FIG. 3C, the illustrative checkout mode proceeds to a section 76 in which the zone dampers are tested. While a total of four zone dampers are referenced in section 76, it will be recognized that a multi-zone HVAC system may include two zones, three zones, five, six, seven or more zones. In some cases, as illustrated, each zone damper is movable between an open position and a closed position. In some instances, however, a zone damper may also have one or more intermediate positions.

In some cases, one or more of the thermostats 56, 58, 60, 62 (FIG. 2) connected to zone control panel 10 may be manipulated to cause one or more of the zone dampers to be opened or closed by zone control panel 10. An installer may physically check the status of the appropriate zone dampers to ensure proper communication between the zone control panel 10 and the zone damper(s). In some embodiments, it is contemplated that the checkout mode may include a functionality in which the installer may get zone control panel 10 to provide, for testing purposes, open/close instructions directly to one or more of the zone dampers without involving any of the thermostats 56, 58, 60, 62.

Figure 3D:
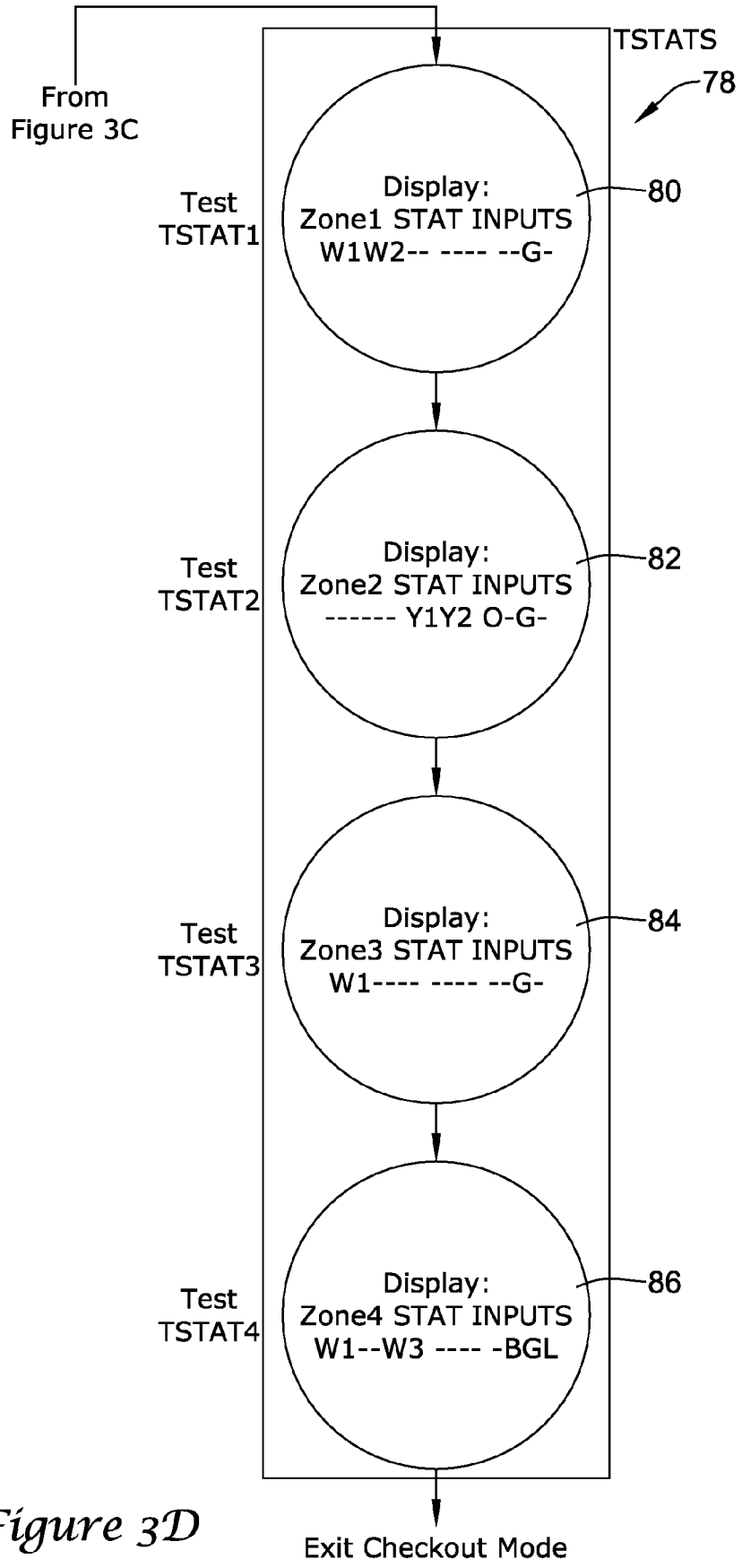

In FIG. 3D, the illustrative checkout mode proceeds to a section 78 in which the electrical connections between zone control panel 10 and each of the connected thermostats 56, 58, 60 and 62 are confirmed. While a total of four thermostats are referenced in section 78, it will be recognized that a multi-zone HVAC system may include fewer or greater than four zones and thus fewer or greater than four thermostats. At block 80, zone control panel 10 verifies proper communication and/or connectivity with thermostat 56. It can be seen that thermostat 56 has been set to call for second stage heating (e.g. W1 and W2 pins are both energized) and that the fan is operational (e.g. the G pin is energized). This information may be displayed on display 16 of FIG. 1, if desired. The installer may used this information to verify proper communication and/or connectivity between the zone control panel 10 and the thermostat 56.

At block 82, zone control panel 10 helps verify proper communication and/or connectivity with thermostat 58. It can be seen that thermostat 58 has been set for second stage cooling (e.g. Y1 and Y2 pins are energized) and that the fan is operational (e.g. G pin is energized). It can also be seen that the cooling equipment, at least, includes a heat pump, as the cooling reversing valve signal (e.g. O pin) has been energized. This information may be displayed on display 16 (FIG. 1), and may be used by the installer to help verify proper communication and/or connectivity with thermostat 58.

At block 84, zone control panel 10 helps verify proper communication and/or connectivity with thermostat 60. It can be seen that thermostat 60 has been set to call for first stage heating (e.g. W1 pin is energized) and that the fan is operational (e.g. G pin is energized). This information may be displayed on display 16 (FIG. 1), and may be used by the installer to help verify proper communication and/or connectivity with thermostat 60.

At block 86, zone control panel 10 helps verify proper connection and/or connectivity with thermostat 62. It can be seen that thermostat 62 has been set to call for emergency heating, which in this case shows two stages of emergency heating (e.g. W1 and W3 pins are energized), and that the fan is operational (e.g. G pin is energized). It can also be seen that the heating equipment, at least, includes a heat pump, as the heating reversing valve (e.g. B pin) has been energized, and that emergency heating is activated (e.g. L pin is energized). If additional thermostats are present, they may be similarly tested. Otherwise, the checkout mode may be exited at this point.

Figure 4:
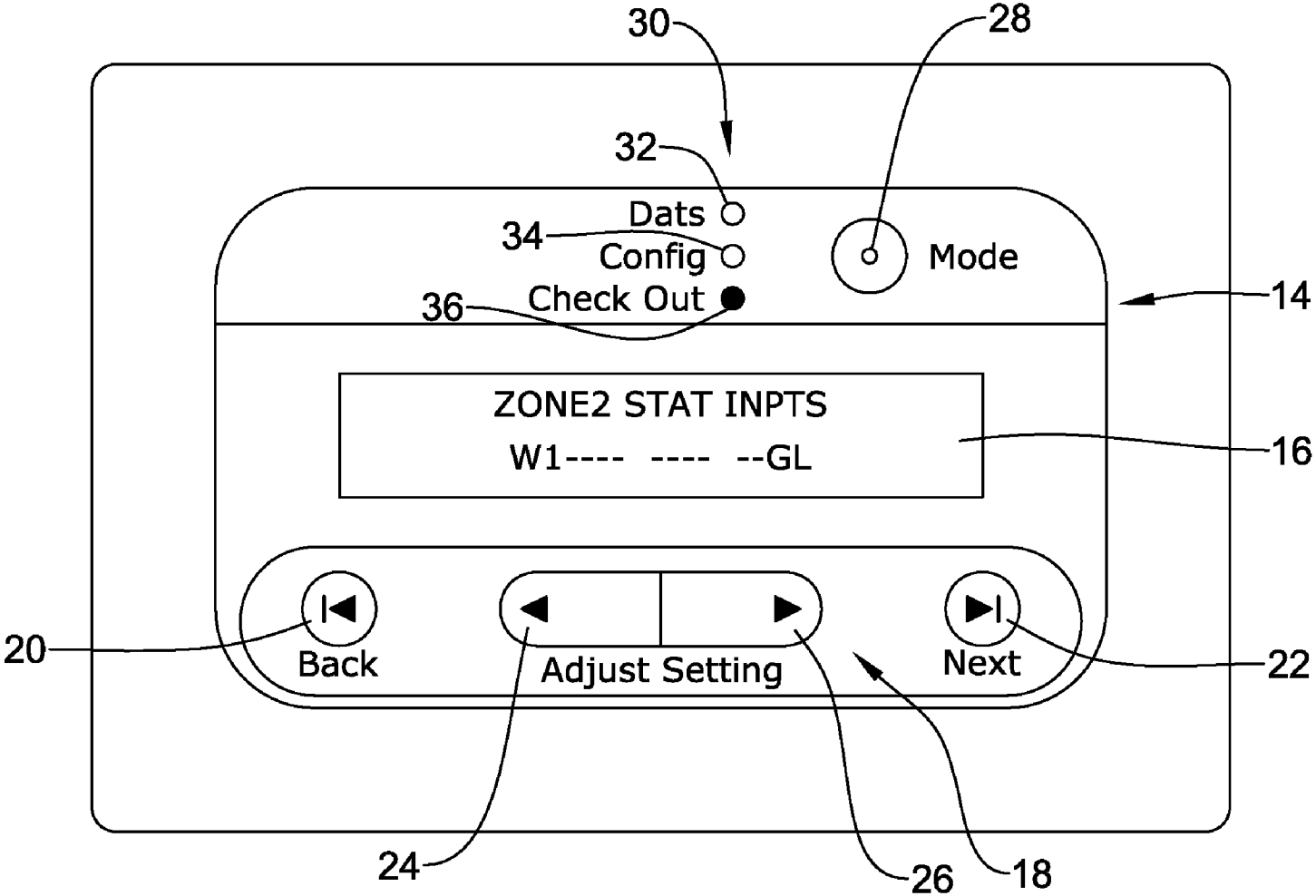
FIG. 4 is a front view of a portion of the illustrative zone control panel of FIG. 1, showing an operating condition.
Figure 5:
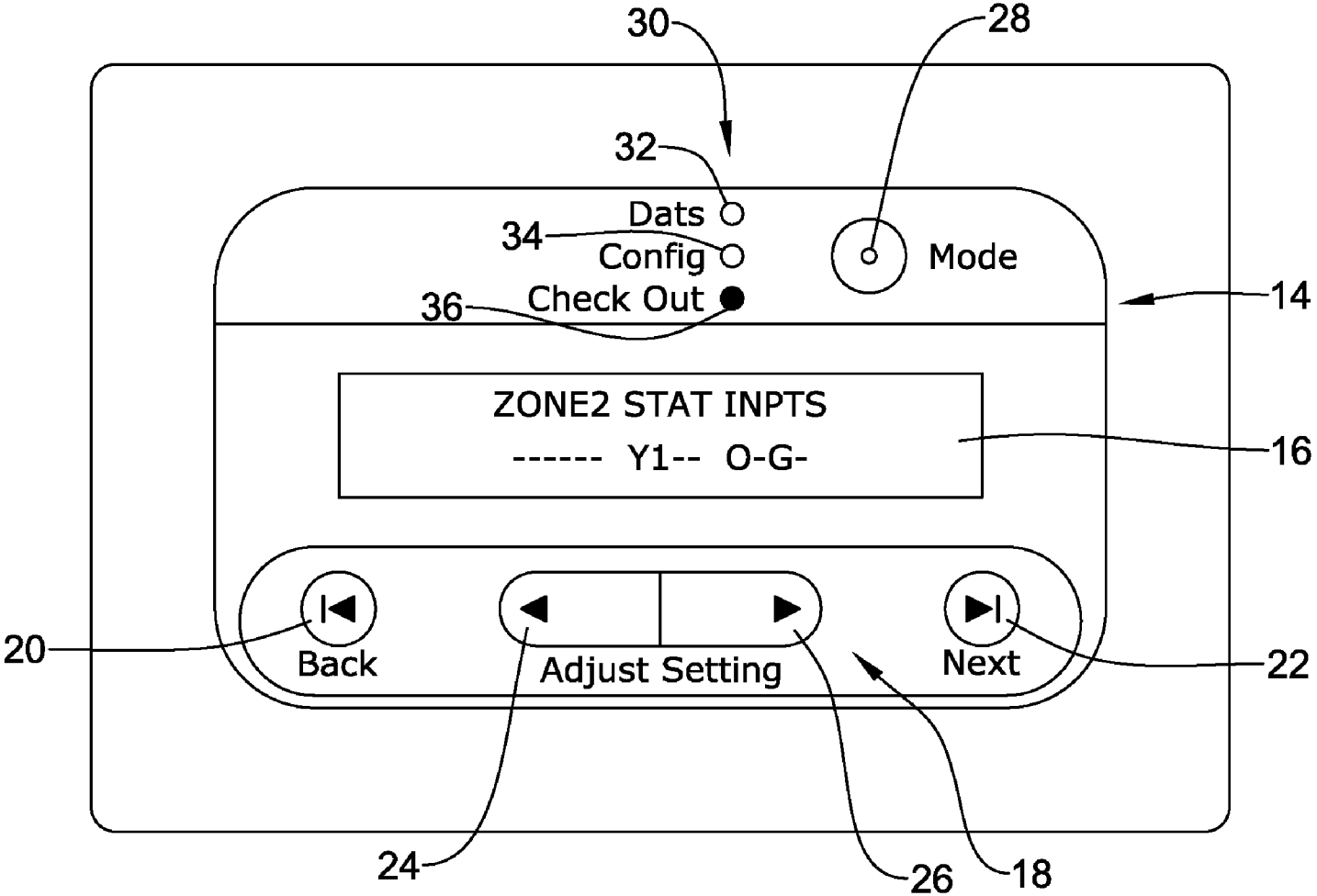
FIG. 5 is a front view of a portion of the illustrative zone control panel of FIG. 1, showing another operating condition in accordance with the present invention.

FIGS. 4 and 5 provide further examples of what may be displayed on display 16 of FIG. 1. In FIG. 4, it can be seen that zone two has been selected using user interface 14, and that the thermostat in zone two is calling for first stage emergency heat (e.g. W1 and L pins are energized) and that the fan is operational (e.g. G pin is energized). In FIG. 5, it can be seen that zone two has again been selected, and that the thermostat in zone two has been set to call for first stage cooling from a heat pump (e.g. Y1 and O pins are energized), and that the fan is operational (e.g. G pin is energized). In both the illustrative embodiments shown in FIGS. 4 and 5, it can be seen that the checkout mode light 36 may be illuminated, when present.

Figure 6:
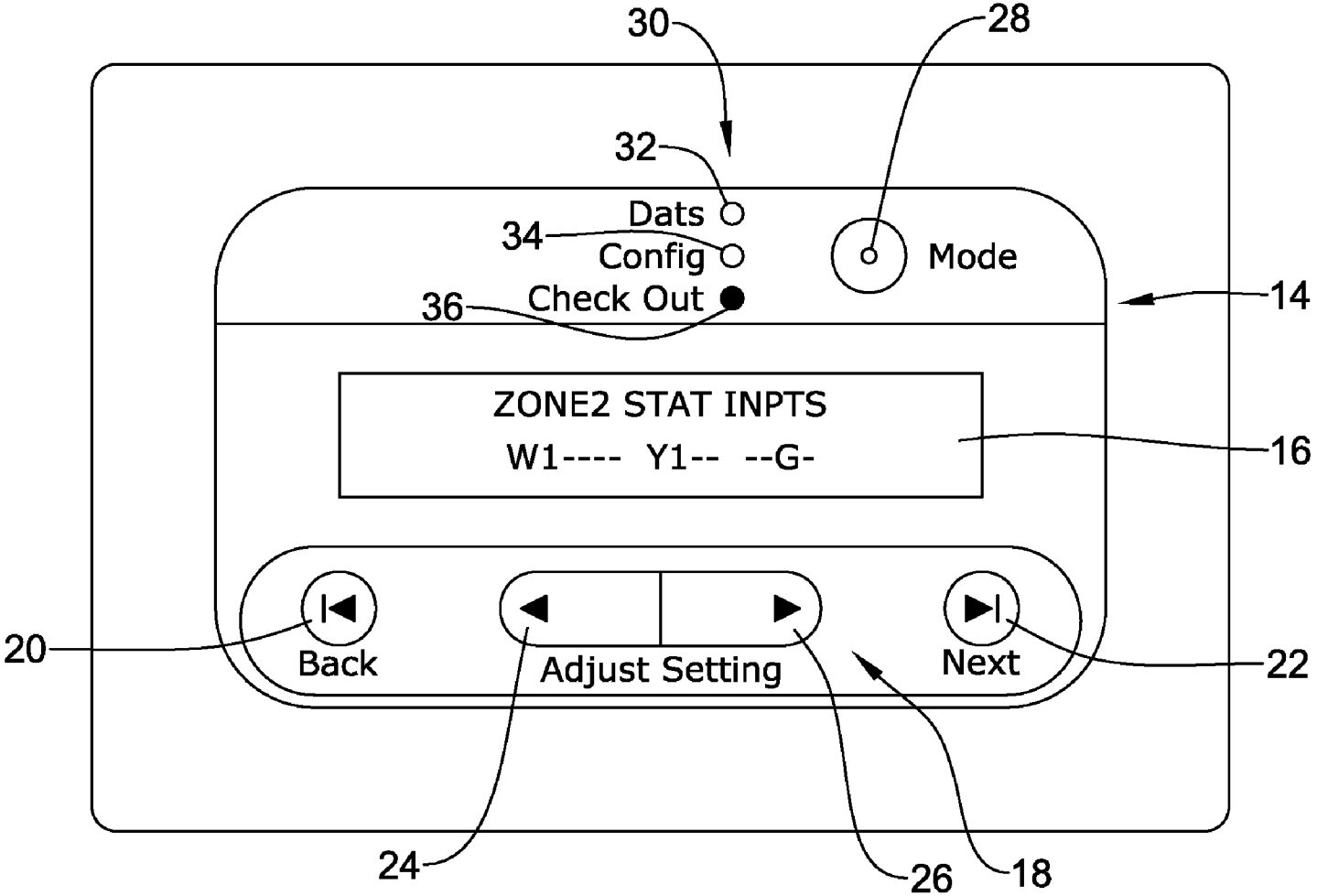
FIG. 6 is a front view of a portion of the illustrative zone control panel of FIG. 1, showing another operating condition in accordance with the present invention.

FIG. 6 provides an example of an indicated error. In testing connections with a thermostat in zone two, an installer has set this particular thermostat to conventional stage one cooling. Consequently, the installer would expect display 16 to show "- - - Y1 - - - G-". However, as can be seen, display 16 actually shows "W1 - - - Y1 - - - G-". This can be interpreted as the W1 pin being hot when it should not be. The installer would be alerted to a possible wiring error.

Figure 7:
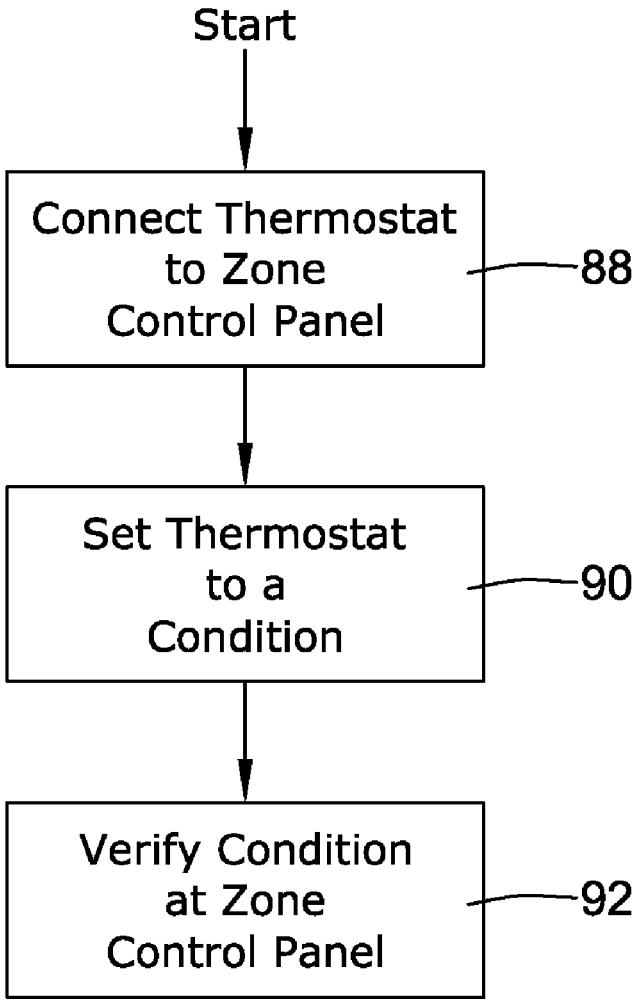
FIG. 7 is a flow diagram showing an illustrative method that may be carried out using the illustrative zone control panel of FIG. 1.

FIGS. 7, 8, 9 and 10 are flow diagrams showing a few illustrative methods that may be carried out using zone control panel 10. In FIG. 7, control starts at block 88, where a thermostat is connected to zone control panel 10 as discussed previously. At block 90, the thermostat is set to a particular condition, such as calling for heating, cooling, ventilation or the like. At block 92, the connection to the thermostat is verified at zone control panel 10 by observing the state of one or more pins via the user interface of the zone control panel.

Figure 8:
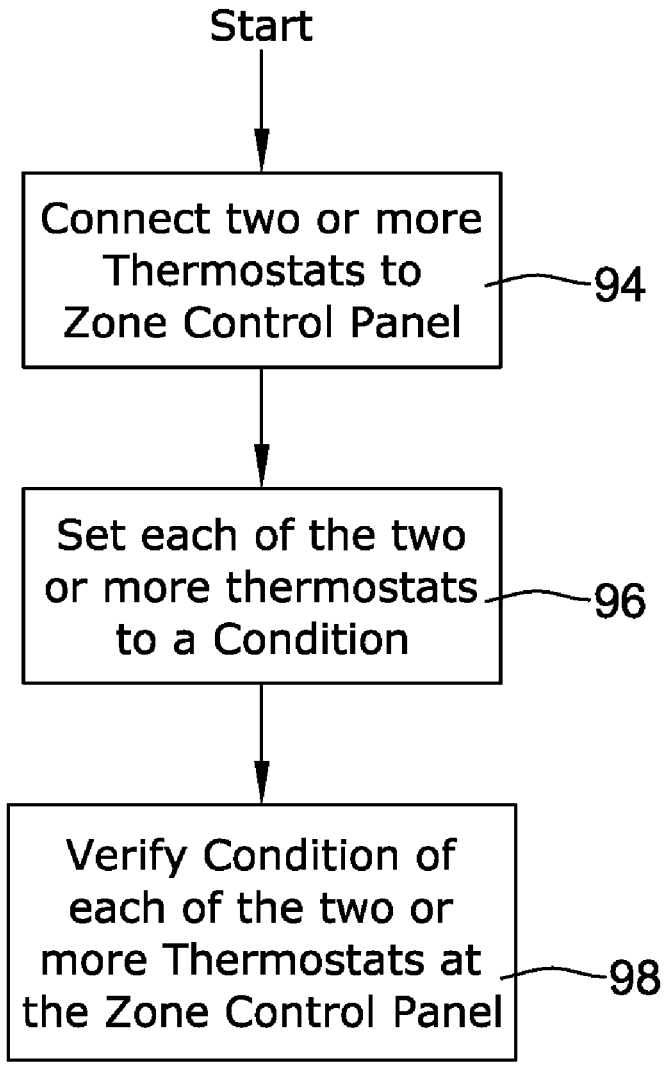
FIG. 8 is a flow diagram showing an illustrative method that may be carried out using the illustrative zone control panel of FIG. 1.

In FIG. 8, the method begins at block 94, where two or more thermostats are connected to zone control panel 10. At block 96, each of the two or more thermostats is set to a particular condition. Each thermostat may be set to a different condition, or two or more of the thermostats may, for example, be set to the same condition. At block 98, the condition of each of the two or more thermostats may be verified at zone control panel 10 by observing the state of one or more pins via the user interface of the zone control panel.

Figure 9:
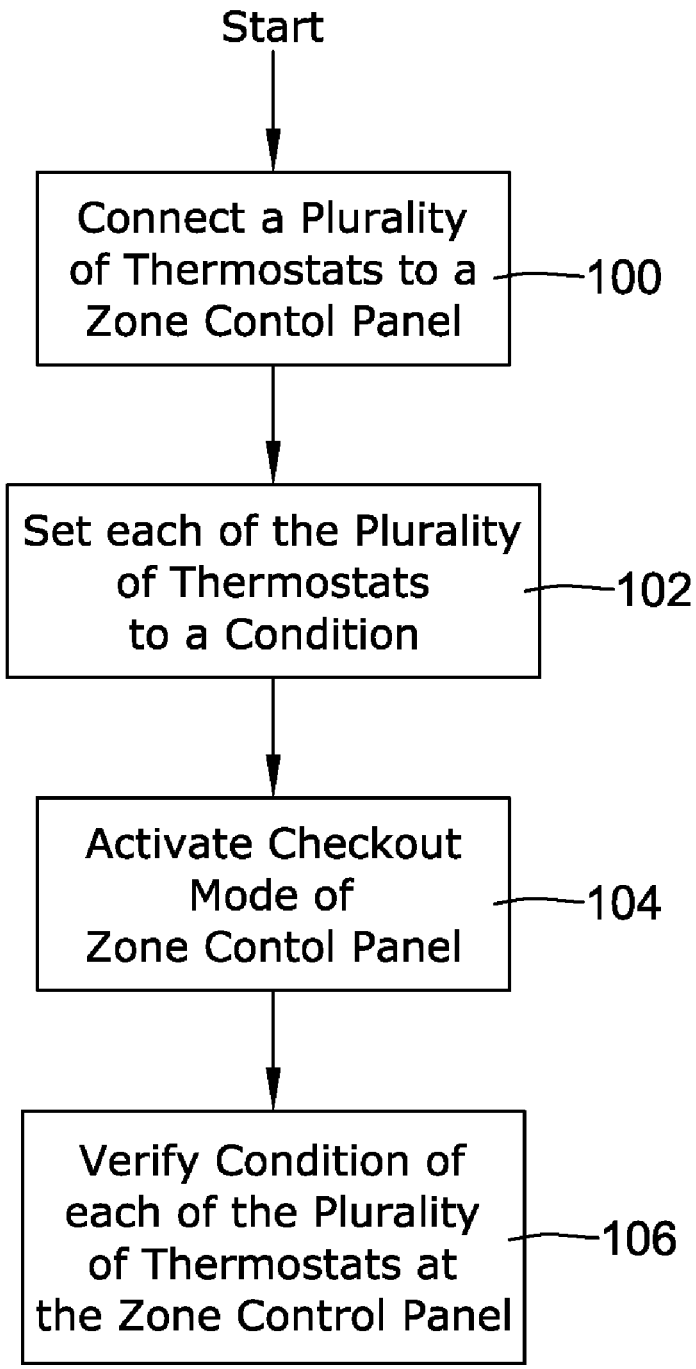
FIG. 9 is a flow diagram showing an illustrative method that may be carried out using the illustrative zone control panel of FIG. 1.

In FIG. 9, control begins at block 100, where a plurality of thermostats are connected to zone control panel 10. Each of the plurality of thermostats may be set to a particular operating condition at block 102. At block 104, the checkout mode of zone control panel 10 may be activated by, for example, manipulating mode button 28 (FIG. 1). Finally, at block 106, the condition of each of the plurality of thermostats may be verified at zone control panel 10 by observing the state of one or more pins via the user interface of the zone control panel.

Figure 10:
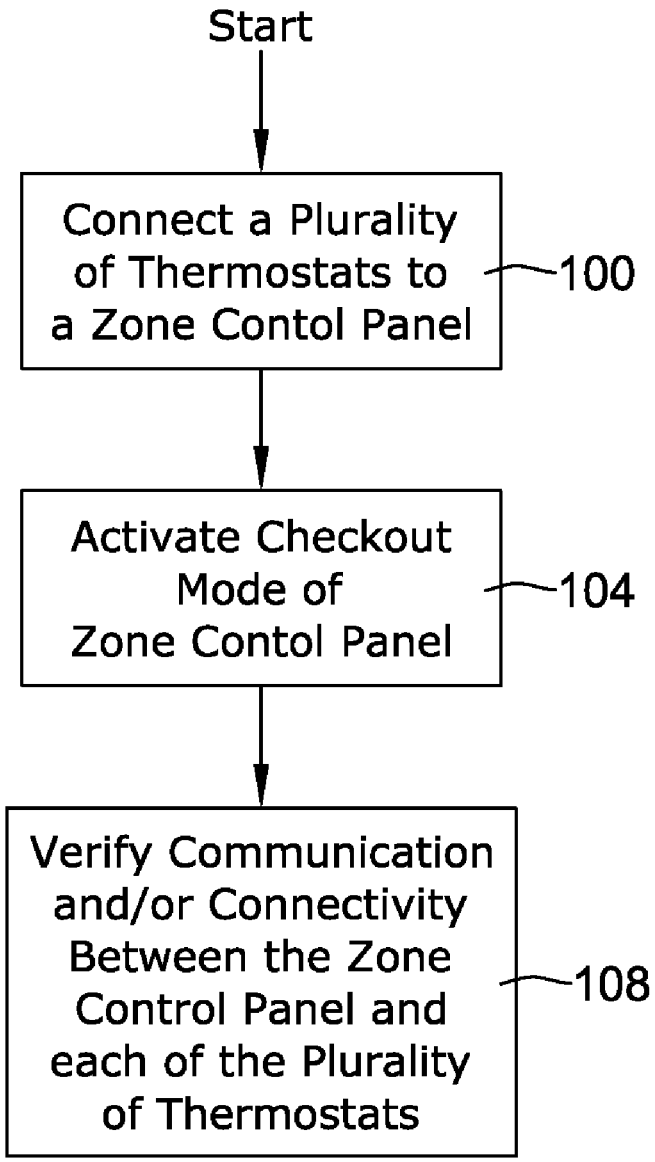
FIG. 10 is a flow diagram showing an illustrative method that may be carried out using the illustrative zone control panel of FIG. 1.

In FIG. 10, a plurality of thermostats are connected to zone control panel 10 at block 100. At block 104, the checkout mode is activated and at block 108, communication and/or electrical connectivity between zone control panel 10 and each thermostat is verified.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A zone control panel configured to receive electrical signals from a plurality of remotely located thermostats, wherein each thermostat corresponding to a particular zone in a conditioned space, the zone control panel comprising:

a mode selector that permits a user to put the zone control panel into a checkout mode;

a zone selector that permits the user to select a particular zone when the zone control panel is in the checkout mode; and a display that provides the user with information related to a state of an electrical signal received by the zone control panel from the particular thermostat that corresponds to the selected zone when in the checkout mode.

2. The zone control panel of claim 1, wherein the electrical signal received by the zone control panel corresponds to a heating call signal.

3. The zone control panel of claim 1, wherein the electrical signal received by the zone control panel corresponds to a cooling call signal.

4. The zone control panel of claim 1, wherein the electrical signal received by the zone control panel corresponds to a fan call signal.

5. The zone control panel of claim 1, wherein the zone control panel is configured to sequentially display information related to the state of two or more electrical signals of each of the plurality of thermostats as the zone selector selects the corresponding zones.

6. The zone control panel of claim 1, wherein the display comprises an alphanumeric display.

7. The zone control panel of claim 1, wherein the display comprises a liquid crystal display.

8. The zone control panel of claim 1, further comprising one or more buttons that permit a user to operate the zone control panel.

9. The zone control panel of claim 1, further comprising a mode indicator light.

10. The zone control panel of claim 9, wherein the mode indicator light is configured to show when the zone control panel is in the checkout mode.

11. A zone control panel configured to receive electrical signals from two or more thermostats and to control a zoned HVAC system accordingly, the zone control panel comprising:

an alphanumeric display;

a controller coupled to the alphanumeric display, the controller structured to selectively display on the alphanumeric display a state of at least one of the electrical signals received from each of the two or more thermostats.

12. The zone control panel of claim 11 further comprising an indicator light selectively indicating a mode of the zone control panel.

13. The zone control panel of claim 11, wherein the two or more thermostats may be manipulated to a particular operating condition, and the zone control panel is configured to permit a user to select a particular thermostat and display the state of at least one of the electrical signals received from the selected thermostat.

14. The zone control panel of claim 13, wherein the zone control panel is configured to permit a user to sequentially display the state of at least one of the electrical signals received from each of the plurality of thermostats.

15. A method of installing a zone control panel that is configured to interact with a plurality of thermostats that each provide one or more electrical signals to the zone control panel, the zone control panel including a display, the method comprising steps of:

connecting the plurality of thermostats to the zone control panel;

setting each of the plurality of thermostats to an operating condition; and displaying a state of at least one of the electrical signals received from each of the plurality of thermostats on the display.

16. The method of claim 15, further comprising a step of placing the zone control panel into a checkout mode before the displaying step.

17. The method of claim 15, wherein the setting step comprises setting each of the one or more thermostats to an operating condition by physically accessing each of the one or more thermostats.

18. The method of claim 17, wherein the setting step comprises changing the operating condition of at least one of the one or more thermostats while the zone control panel is displaying the state of at least one of the electrical signals.

* * * * *